US008443537B2

(12) United States Patent
Curry

(10) Patent No.: US 8,443,537 B2
(45) Date of Patent: May 21, 2013

(54) DROP SAFETY FOR A FIRING PIN OF A FIREARM

(75) Inventor: Brett Curry, Monson, MA (US)

(73) Assignee: Smith & Wesson Corp., Springfield, MA (US)

( * ) Notice: Subject to any disclaimer, the term of this patent is extended or adjusted under 35 U.S.C. 154(b) by 61 days.

(21) Appl. No.: 13/242,748

(22) Filed: Sep. 23, 2011

(65) Prior Publication Data

US 2013/0074391 A1 Mar. 28, 2013

(51) Int. Cl.
*F41A 17/64* (2006.01)

(52) U.S. Cl.
USPC ..... 42/70.08; 42/66

(58) Field of Classification Search
USPC ..... 42/66, 70.01, 70.08
See application file for complete search history.

(56) References Cited

U.S. PATENT DOCUMENTS

| | | | | |
|---|---|---|---|---|
| 3,724,113 | A * | 4/1973 | Ludwig | 42/70.08 |
| 3,830,002 | A * | 8/1974 | Volkmar | 42/70.08 |
| 4,021,955 | A * | 5/1977 | Curtis | 42/70.08 |
| 4,454,673 | A * | 6/1984 | Meidel | 42/70.08 |
| 4,555,861 | A * | 12/1985 | Khoury | 42/69.01 |
| 4,843,748 | A * | 7/1989 | Tuma | 42/70.08 |
| 5,157,209 | A * | 10/1992 | Dunn | 42/70.08 |
| 5,245,776 | A * | 9/1993 | Dornaus | 42/70.08 |
| 5,437,120 | A * | 8/1995 | Dornaus | 42/70.08 |
| 6,240,670 | B1 * | 6/2001 | Findlay | 42/70.08 |
| 6,256,918 | B1 * | 7/2001 | Szabo | 42/70.08 |
| 6,330,761 | B1 | 12/2001 | Duval et al. | |
| 6,374,526 | B1 * | 4/2002 | Mochak | 42/70.08 |
| 6,523,294 | B2 | 2/2003 | Curry et al. | |
| 6,530,168 | B2 * | 3/2003 | Shimi et al. | 42/70.08 |
| 6,539,658 | B1 * | 4/2003 | Hubert et al. | 42/70.08 |
| 7,059,075 | B1 | 6/2006 | Curry et al. | |
| 7,204,051 | B2 * | 4/2007 | Thomele et al. | 42/70.08 |
| 7,213,359 | B2 * | 5/2007 | Beretta | 42/70.08 |
| 7,254,913 | B2 | 8/2007 | Dubois et al. | |
| 7,263,795 | B1 | 9/2007 | Curry | |
| 7,698,845 | B2 * | 4/2010 | Hochstrate et al. | 42/69.03 |
| 7,861,450 | B2 | 1/2011 | Curry | |
| 7,886,469 | B2 | 2/2011 | Curry | |
| 8,033,043 | B2 * | 10/2011 | McGarry | 42/70.08 |
| 2010/0170129 | A1 | 7/2010 | Curry | |
| 2010/0170131 | A1 | 7/2010 | Zukowski | |
| 2010/0170132 | A1 | 7/2010 | Zukowski | |
| 2010/0170138 | A1 | 7/2010 | Zukowski | |
| 2010/0232151 | A1 | 9/2010 | Jones | |
| 2011/0232150 | A1 | 9/2011 | Zukowski | |
| 2012/0180357 | A1 * | 7/2012 | Dietel et al. | 42/70.06 |

FOREIGN PATENT DOCUMENTS

| | | | |
|---|---|---|---|
| DE | 4013124 | A1 * | 10/1991 |
| EP | 1281924 | A1 * | 2/2003 |

* cited by examiner

*Primary Examiner* — Benjamin P Lee
(74) *Attorney, Agent, or Firm* — Ballard Spahr

(57) ABSTRACT

A firearm has a firing mechanism that includes a firing pin, a drop safety, a spring mounted to the drop safety and a trigger in mechanical communication with the firing pin and the drop safety. The drop safety includes a roller portion having an outer circumferential surface and an inner opposing wall. When the trigger is actuated, the opposing wall of the drop safety abuts and engages the firing pin in the forward-most axial position thereof, thereby allowing the firing pin to strike a primer of a chambered round of ammunition. In all other configurations, the spring rotationally biases the drop safety so that the outer circumferential surface of the roller portion of the drop safety blocks the forward axial reciprocation of the firing pin, preventing the firing pin from engaging the primer of a chambered round of ammunition.

9 Claims, 6 Drawing Sheets

DROP SAFETY FOR A FIRING PIN OF A FIREARM

FIELD OF THE INVENTION

The present invention generally relates to a safety for a firearm and, more specifically, to drop safety for blocking the forward axial reciprocation of a firing pin of a firearm.

BACKGROUND OF THE INVENTION

Firing mechanisms of a firearm often utilize hammer-initiated firing pins. In firearms that employ this design, the trigger is connected to a hammer-cocking and hammer-releasing mechanism, whereby movement of the trigger causes the hammer to cock and, once cocked, release in a forward rotation about a pivot. Upon rotation, the hammer strikes a rear end of the firing pin, which drives the firing pin axially forward, toward a chambered round of ammunition.

Various devices have been used to prevent the firing pin from moving as a result of agitation or impact, such as a dropping of the firearm, that is not related to an intentional discharging of the firearm. Such devices include firing pin safeties that incapacitate axial movement of the firing pin.

Firing pin safeties typically consist of a mating element that is pivotally or reciprocally mounted adjacent to the respective firing pin such that, when the trigger is not actuated, the firing pin safety rests against the firing pin, thereby blocking the forward motion of the firing pin.

For example, a safety device is described in U.S. Patent Application No. 2010/0170131, which is assigned to Smith and Wesson Corporation and is incorporated herein by reference. The safety device includes a flange that is spring biased into contact with a lobe of the firing pin, thereby blocking the firing pin from reciprocating axially forward and into contact with a primer of a chambered round of ammunition. The flange is reciprocally actuated out of engagement with the lobe by a pivot lock arm, which is pivotally mounted to a hammer pin of a hammer-type firing mechanism. When the trigger is actuated, the hammer-type firing mechanism is drawn rearward, which causes the pivot lock arm to rotate and, thereby, actuate the flange out of engagement with the lobe of the firing pin. Accordingly, the firing pin is blocked from forward reciprocation to discharge a chambered round of ammunition unless and until the trigger is actuated.

However, firing pin safeties known in the prior art oftentimes involve complex mechanisms and are difficult to install within the frame of the firearm.

The object of the present invention is, therefore, to provide a safety device for a firearm, which, among other desirable attributes, significantly reduces or overcomes the above-mentioned deficiencies of safety devices.

SUMMARY OF THE INVENTION

Accordingly, the present invention provides a drop safety for blocking the forward axial reciprocation of a firing pin of a firearm.

In an aspect of the present invention, a firearm is provided that includes a trigger that is in mechanical communication with a hammer-type firing mechanism including a hammer, a firing pin that is actuated by the hammer and a drop safety that blocks the forward reciprocation of the firing pin unless and until the trigger is actuated.

In an aspect of the present invention, the drop safety has a roller portion with an outer circumferential surface that is releasably engaged by a rearward surface of an axial carveout of a firing pin. In another object of the present invention, the drop safety is provided with a spring, whereby the spring rotationally biases the drop safety so that the outer circumferential surface of the roller portion of the drop safety blocks the firing pin from reciprocating axially forward unless and until the trigger is actuated.

In another aspect of the present invention, the drop safety has a roller portion with an inner limiting wall that creates a fixed stop for the firing pin in the forward axial reciprocation thereof, the drop safety rotating in response to the actuation of the trigger so that the inner limiting wall faces the firing pin.

It is an object of the present invention to provide a drop safety that is installed independent of (i.e., not in an integral or interconnected manner with) a firing mechanism of a firearm.

These and other features of the present invention are described with reference to the drawings of preferred embodiments of a drop safety. The illustrated embodiments of the drop safety of the present invention are intended to illustrate, but not limit, the invention.

BRIEF DESCRIPTION OF THE DRAWINGS

The accompanying drawings, which are incorporated in and constitute a part of this specification, illustrate embodiments of the disclosure, and together with a general description of the disclosure given above, and the detailed description of the embodiments given below, serve to explain the principles of the disclosure.

Other features and advantages of the present disclosure will become apparent from the following detailed description, taken in conjunction with the accompanying drawings, which illustrate, by way of example, the principals of the invention.

DETAILED DESCRIPTION OF THE PREFERRED EMBODIMENTS

Figure 1:
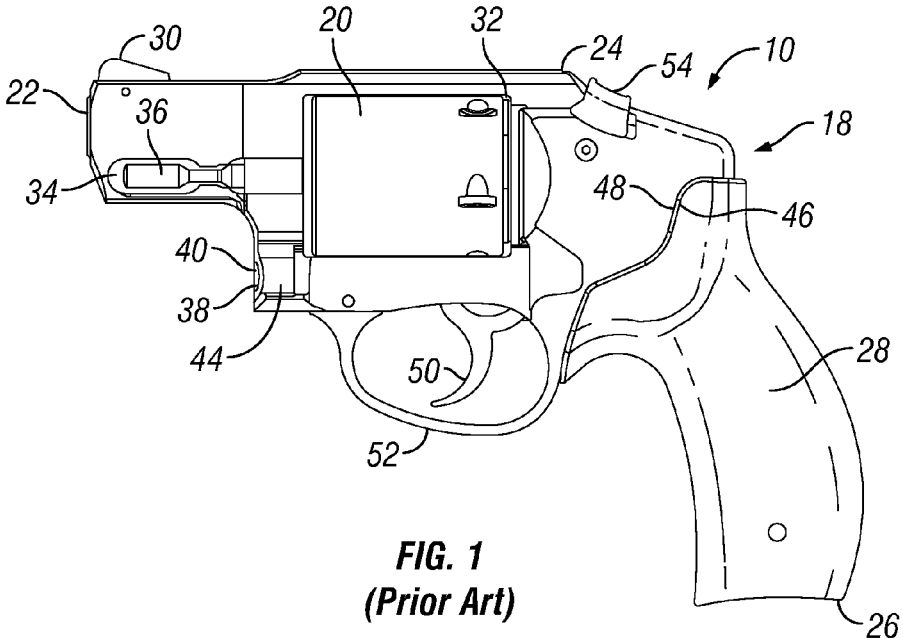
FIG. 1 (Prior Art)
FIG. 1 illustrates a side view of a firearm according to the prior art.
Figure 2:
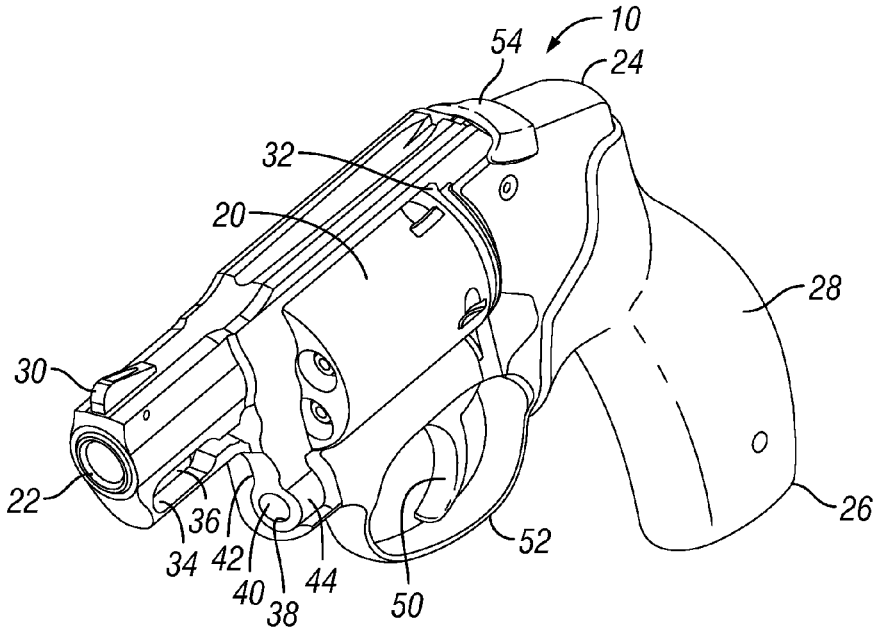
FIG. 2 (Prior Art)
FIG. 2 illustrates a perspective view of the firearm of FIG. 1.

Referring now to the drawings, in which like reference numerals identify identical or substantially similar parts throughout the several views, FIGS. 1 and 2 illustrate one exemplary embodiment of a firearm known in the art is shown generally at 10 and is hereinafter referred to as "firearm 10." The firearm 10 is, preferably, a revolver that includes a frame 18, a cylinder 20, a barrel 22, and a firing mechanism (not shown for clarity). The operation and structure of the known firearm 10 is described in: U.S. Pat. No. 6,330,761 entitled "BLAST SHIELD APPARATUS AND METHOD OF ASSEMBLY FOR A REVOLVER"; U.S. Pat. No. 6,523,294 entitled "REVOLVER-SAFETY LOCK MECHANISM"; U.S. Pat. No. 7,059,075 entitled "CYLINDER RETAINING MECHANISM"; U.S. Pat. No. 7,254,913 entitled "REVOLVER FOR FIRING HIGH VELOCITY AMMUNITION"; U.S. Pat. No. 7,263,795 entitled "EXTRACTOR FOR A REVOLVER"; U.S. Pat. No. 7,861,450 entitled "FIREARM HAVING NONMETALLIC COMPONENTS AND AN AMBIDEXTROUS CYLINDER RELEASE LEVER"; and U.S. Pat. No. 7,886,469 entitled "FIREARM HAVING NONMETALLIC COMPONENTS AND AN EXTRACTOR YOKE LOCKUP", which are incorporated herein by reference.

The frame 18 is generally comprised of two halves, an upper frame portion 24 and a lower frame portion 26. The lower frame portion 26 contains a back strap, a main spring housing and a grip 28, as well as space for a portion of the firing mechanism, such as a sear (not shown for clarity).

The upper frame portion 24 contains the barrel 22 and the sight 30, as well as space for another portion of the firing mechanism (not shown for clarity). The upper frame portion 24 also contains: a rectangular aperture 32 into which the cylinder 20 is mounted, a locking bolt recess 34 that slidably receives a locking bolt 36, a yoke stud recess 38 into which a yoke stud 40 is secured and a yoke carve out 42 that is fitted to the yoke 44.

A forward end 46 of the lower frame portion 26 is shaped so as to accept a corresponding rearward end 48 of the upper frame portion 24. These upper and lower frame portions 24, 26 are joined together via pins (not shown for clarity) to create a structurally rigid frame. The frame portions 24, 26 are comprised of metal stampings or inserts having a polymer over-molding on top of the inserts.

The firearm 10 also includes a trigger 50 that is pivotally attached to the upper frame portion 24 and a separate trigger guard 52 that is releasably attached to both the upper and lower frame portions 24, 26. The trigger 50 is in mechanical communication with the firing mechanism (not shown for clarity) of the firearm 10.

The cylinder 20 is rotatably mounted on a cylindrical portion of the yoke 44. The cylinder 20 may be pivoted into and out of the rectangular aperture 32 in the upper frame portion 24 along the pivot path defined by the yoke 44. For instance, the cylinder 20 is rotated out of the page of FIG. 1. In addition, the cylinder 20 may be rotated about the cylindrical portion of the yoke 44 (i.e., whether in or out of the rectangular aperture 32).

A cylinder release lever 54 is mounted to an upper rear surface of the upper frame portion 24. Actuation of the cylinder release lever 54 enables the cylinder 20 to be pivoted out of the rectangular aperture 32.

Figure 3:
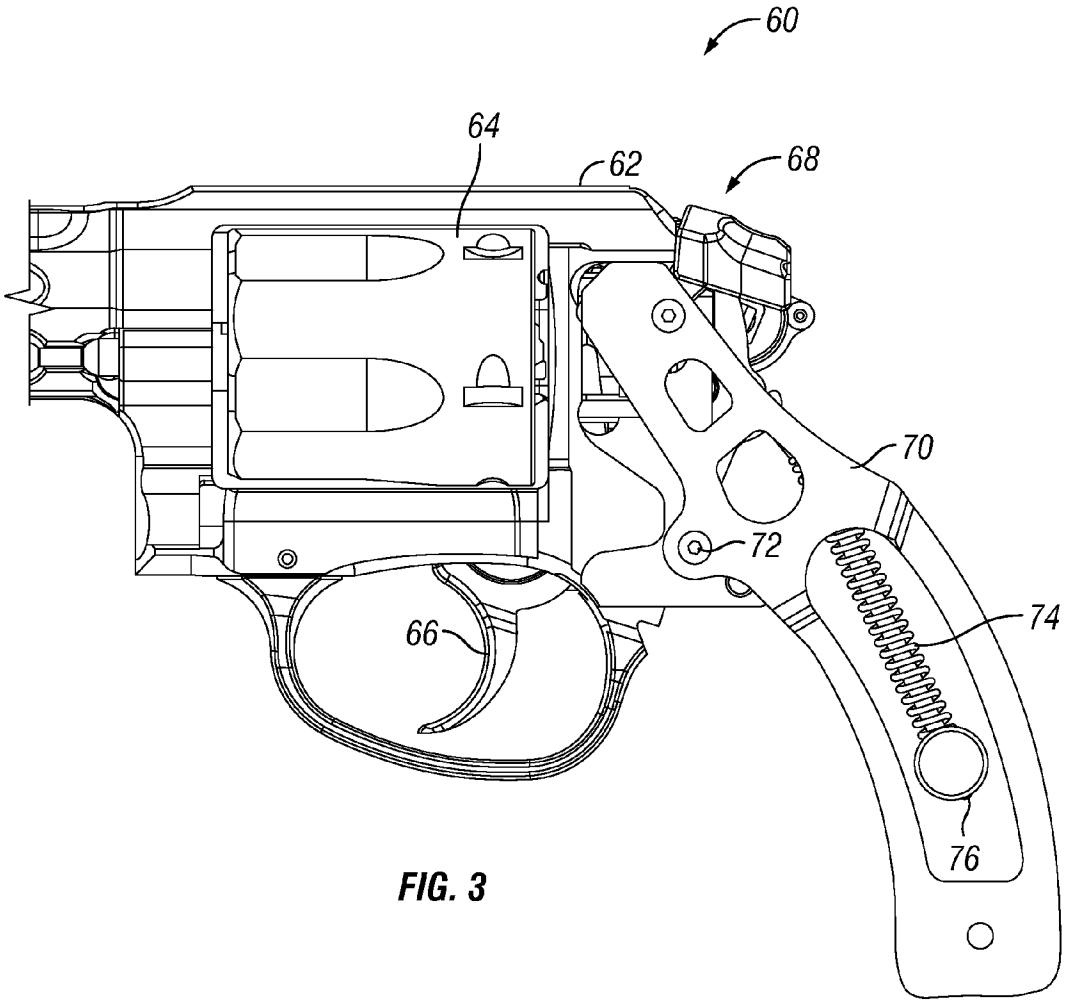
FIG. 3 illustrates a side view of a firearm according to an embodiment of the present invention, the firearm having a portion of the frame removed for illustrative purposes.

Referring to FIG. 3, a firearm 60 according to the present invention is shown with part of the upper frame portion 24 and the lower frame portion 26, including the grip 28, removed for illustrative purposes. The firearm 60 is shown with a cylinder block portion 62 of the upper frame portion 24, which has a cylinder 64 mounted therein, and a trigger 66 that is in mechanical communication with a firing mechanism 68 of the firearm 60.

The firearm 60 also includes a housing 70 that substantially encases and frames the firing mechanism 68 and is connected to the upper frame portion 24 by, at least, a pin 72 located near the trigger 66. The housing 70 includes two substantially flat members, with one member being located on each side of the firing mechanism 68 of the firearm 60. The housing 70 extends into the grip of the firearm 60 and a sear 74 is located in the grip-portion of the housing 70. A first (i.e., remote) end 76 of the sear 74 is mounted to the grip.

Figure 5:
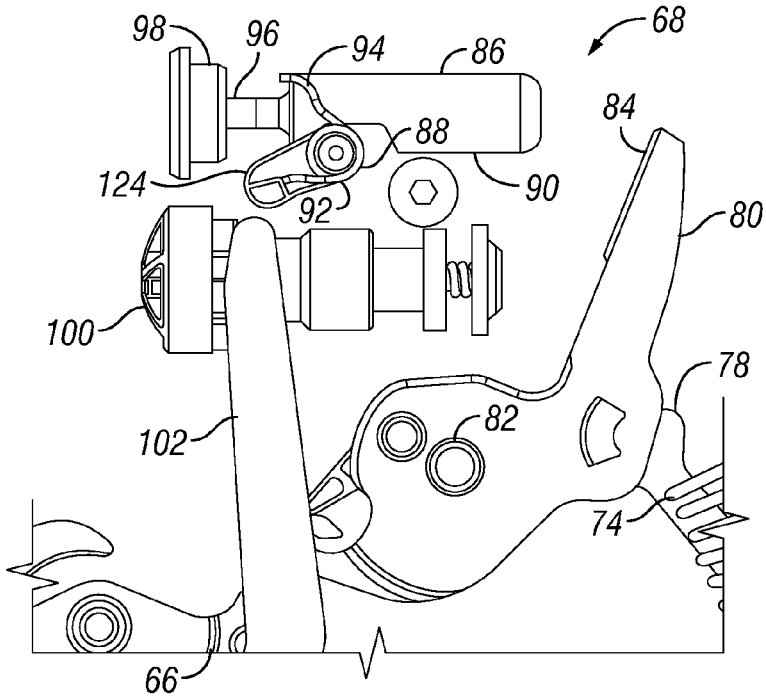
FIG. 5 illustrates a side view of a firing mechanism of the firearm of FIG. 3 in a first trigger-actuated position.
Figure 6:
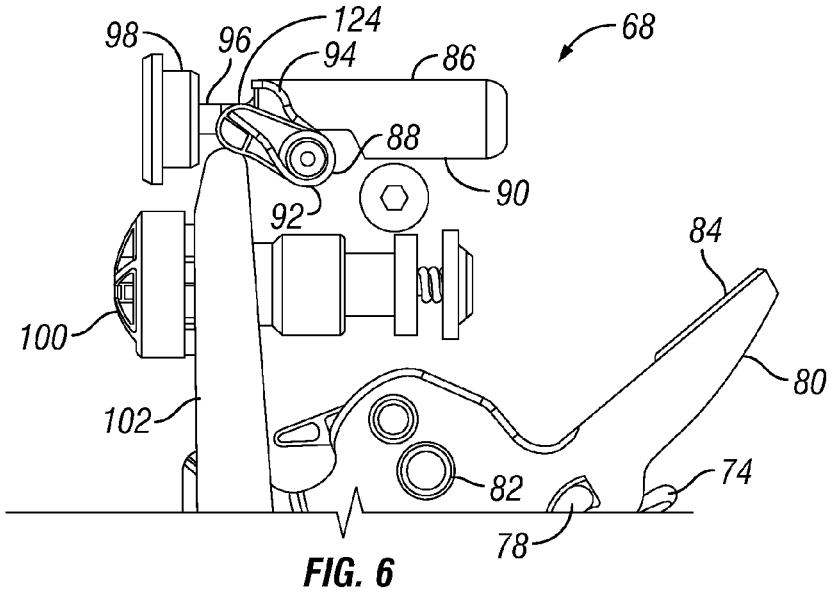
FIG. 6 illustrates a side view of a firing mechanism of the firearm of FIG. 3 in a second trigger-actuated position.
Figure 7:
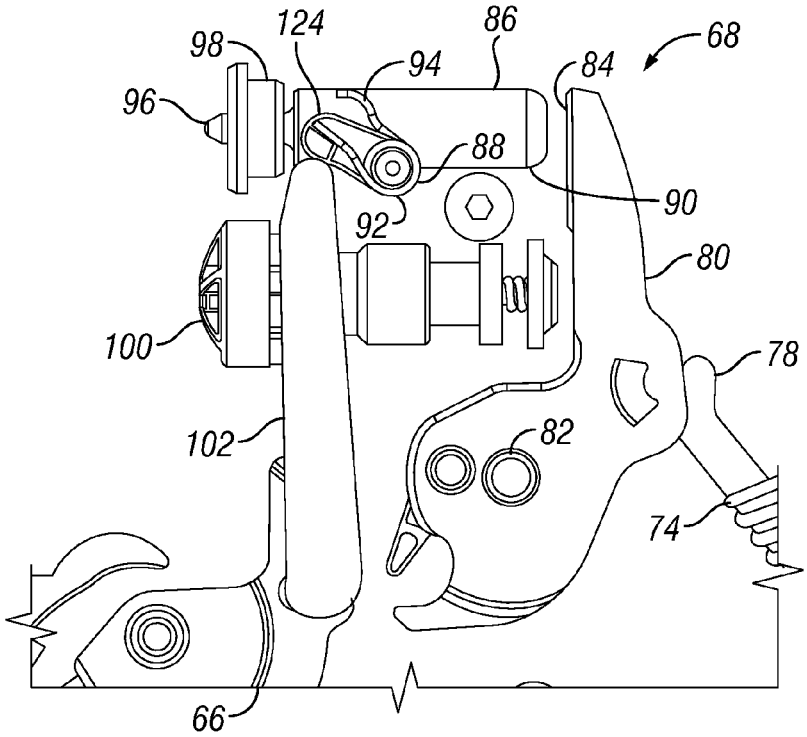
FIG. 7 illustrates a side view of a firing mechanism of the firearm of FIG. 3 in a fully trigger actuated position.

Referring to FIGS. 4-7, the firing mechanism 68 of the firearm 60 is shown at various stages of firing from the resting position (see FIG. 4) through to the firing or discharging position (see FIG. 7). In other words, FIGS. 4 through 7 correspond to the increased rearward actuation of the trigger during one trigger pull.

Figure 4:
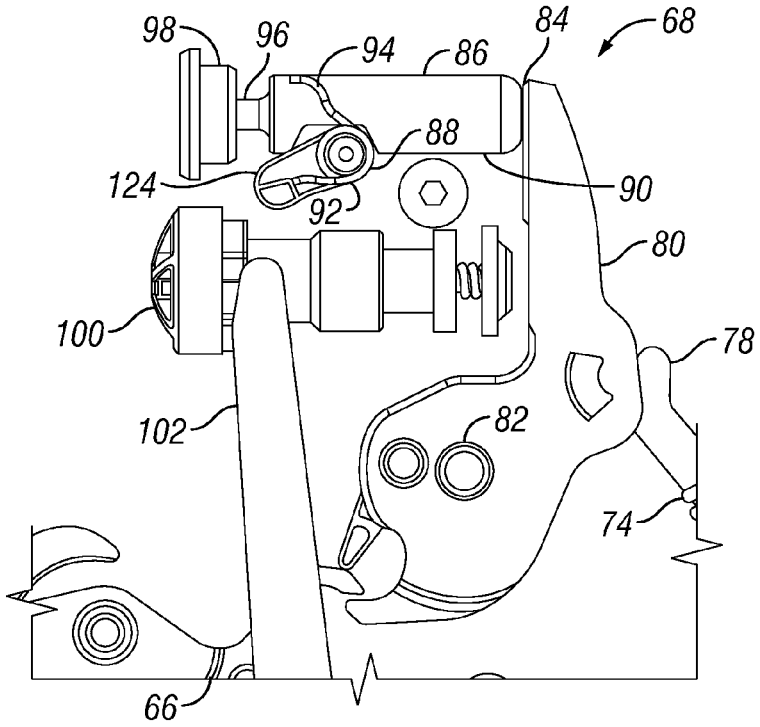
FIG. 4 illustrates a side view of a firing mechanism of the firearm of FIG. 3 in a resting position.

Referring now to FIG. 4, in which the housing 70 is removed from the firearm 60 for illustrative purposes, a second end 78 of the sear 74 is connected to a hammer 80 of the firing mechanism 68.

The hammer 80 is pivotally mounted within the housing 70 by a hammer pin 82. A top, striking portion 84 of the hammer 80 abuts a rear end of an inertia firing pin 86, which is axially aligned with a chamber of the cylinder 64.

Toward the front of the firing pin 86 from the hammer 80, a drop safety 88 is positioned to abut a bottom surface 90 of the firing pin 86. The drop safety 88 has a roller portion 92 that is rotatably retained by a pair of recesses formed at corresponding positions in each member of the housing 70.

A coil spring 94 is mounted to one side of the drop safety 88 to spring bias the drop safety 88 into a blocking position, as shown in FIG. 4.

Further toward the front of the firing pin 86, a striking tip 96 extends from the front end of the firing pin 86. The striking tip 96 is received by a bushing 98, which generally retains the firing pin 86 within the housing 70 and out of the chamber of the cylinder 64.

A ratchet hub drive mechanism 100 is positioned axially rearward of an extractor (not shown for clarity) that is disposed at the center of the cylinder 64, when the cylinder 64 is in the closed-position. A hand 102 of the firing mechanism 68 is reciprocally mounted near the front of the ratchet hub drive mechanism 100. The hand 102 is in mechanical communication with the trigger 66.

Referring to FIG. 5, when the trigger 66 is actuated, the hammer 80 is rotated rearward toward a cocked position.

In addition, as the trigger 66 is actuated, the hand 102 reciprocates upward to engage the ratchet hub drive mechanism 100.

Referring to FIG. 6, as the trigger 66 is further actuated, the hammer 80 is rotated further rearward into the cocked position, as shown in FIG. 6.

In addition, the hand 102 engages and rotates the ratchet hub drive mechanism 100, thereby causing the cylinder 64 to rotate about the yoke 44, which aligns the next chamber of the cylinder 64 with the barrel of the firearm 60. The ratchet hub drive mechanism 100 is described in greater detail in U.S. Pat. Nos. 7,861,453 and 7,886,469, which were previously incorporated herein by reference.

As the trigger 66 is further actuated, the hand 102 engages and rotates the drop safety 88 out of the blocking position as shown in FIG. 6.

Referring to FIG. 7, as the trigger 66 is fully actuated, the hammer 80 is released from the cocked position under the compressive force of the sear 74, thereby driving the hammer 80 into engagement with the firing pin 86. The hammer 80 drives the firing pin 86 into the forward axial position, as shown in FIG. 7, such that the striking tip 96 extends through the bushing 98 to ignite the primer of a chambered round of ammunition in the cylinder 64, thereby discharging the firearm 60.

Figure 8:
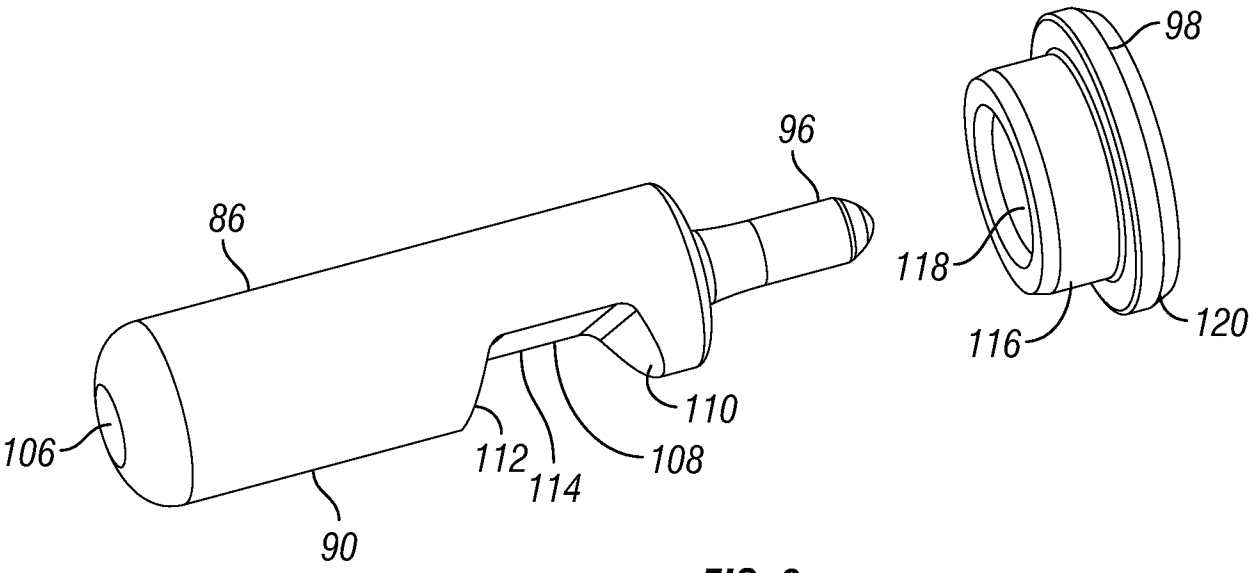
FIG. 8 illustrates an exploded perspective view of an firing pin and a bushing according to an embodiment of the present invention.

As shown in FIG. 7, the drop safety 88 is rotated out of the blocking position, which allows the firing pin 86 to reciprocate axially forward. In all other configurations, the drop safety 88 blocks the firing pin 86 from moving forward into the firing position, as shown in FIG. 7, unless and until the trigger is actuated Referring to FIG. 8, the firing pin 86 is shown exploded from the bushing 98. The rear end of the firing pin 86 is generally spherically shaped, but includes a flat surface 106 at the rearmost tip. The bottom surface 90 of the firing pin 86 defines an axial carveout 108 having a front wall 110 and a rear wall 112 that are connected by a flat axial surface 114. As shown in FIGS. 4 and 5, the rear wall 112 is positioned to engage the drop safety 88 and prevent the striking tip 96 from extending forward past the bushing 98 when the drop safety 88 is not engaged by the hand 102. As shown in FIGS. 6 and 7, the rotation of the drop safety 88 by the hand 102 disengages the rear wall 112 from the firing pin 86 and allows the striking tip 96 to extend forward past the bushing 98 and to engage the primer of a round of ammunition chambered in the cylinder.

The axial carveout 108 extends substantially half of the way through the firing pin 86, for instance, such that the flat axial surface 114 abuts a radial center of the firing pin 86. The axial carveout 108 is generally positioned substantially frontward in the firing pin 86, toward the striking tip 96.

Preferably, the front wall 110 and the rear wall 112 are slightly angled in the radial direction relative to the firing pin 86. For instance, the front wall 110 and the rear wall 112 are angled at between about a forty-five and about ninety degree (45° to 90°) angle relative to the axial direction of reciprocation of the firing pin 86.

The bushing 98 is mushroom shaped and has a cylindrical body portion 116 that defines a hole 118 through which the striking tip 96 is received. The cylindrical body portion 116 of the bushing 98 is fitted to mount to a circular aperture formed in a breech wall of the rectangular aperture 32 of the cylinder block portion 62 of the frame of the firearm 60. The bushing 98 also includes a flange portion 120 that is fitted to lie flush with the surface of the breech wall, facing the cylinder 64.

Figure 9:
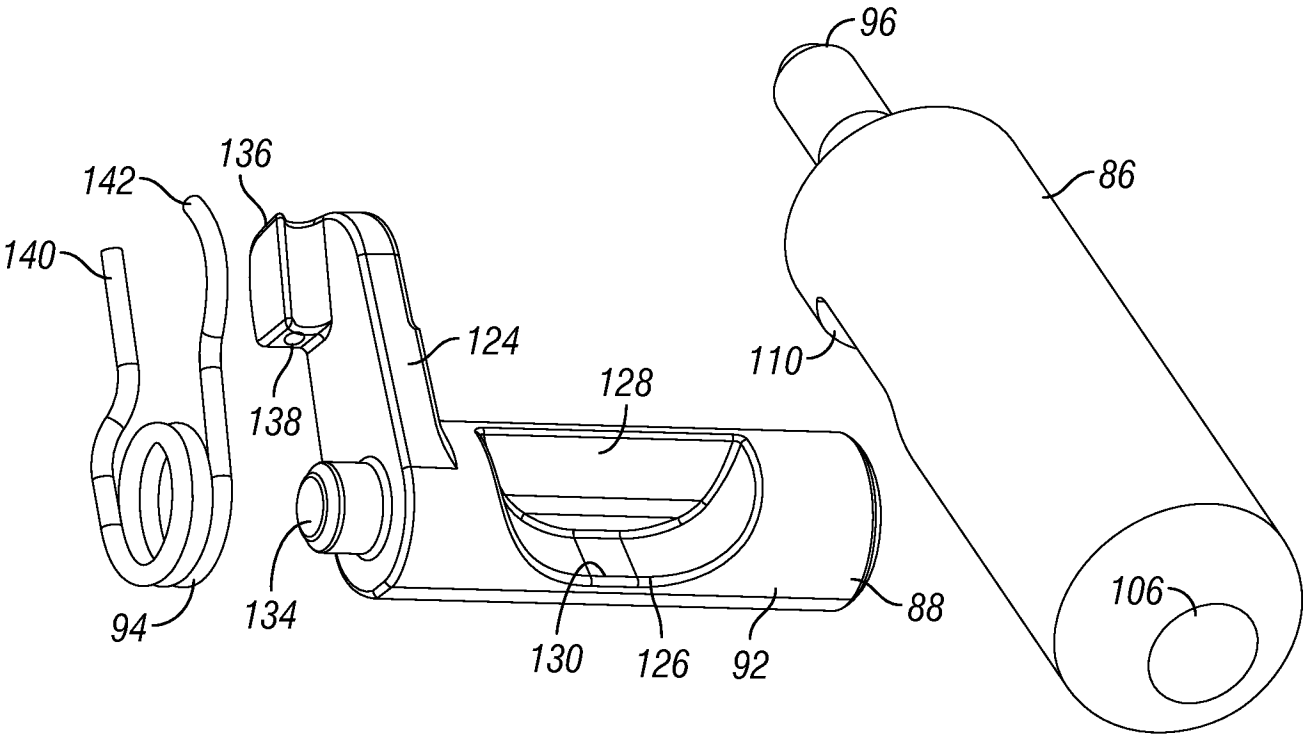
FIG. 9 illustrates an exploded perspective view of an firing pin, a drop safety and a coil spring according an embodiment of the present invention.

Referring to FIG. 9, the firing pin 86, the drop safety 88 and the coil spring 94 are shown exploded from one another. The drop safety 88 includes the roller portion 92 and a wing portion 124. The roller portion 92 defines an outer surface 126 having a sectional carveout 128. The coil spring 94 rotationally biases the drop safety 88 so that the outer surface 126 blocks the rear wall 112 of the firing pin 86 unless and until the trigger is actuated.

The sectional carveout 128 has an opposing wall 130 that, when the trigger is actuated, faces and releasably contacts the rear wall 112 of the firing pin 86 as the firing pin 86 reciprocates into the axially forward position, as shown in FIG. 7. Preferably, the opposing wall 130 is slightly inclined to correspond to the slope of the rearwall 112 of the drop safety 88.

The sectional carveout 128 also has a limiting wall 132 that faces and releasably contacts the bottom surface 90 of the firing pin 86 when the drop safety 88 is rotated fully by the actuation of the trigger 66 and the firing pin 86 is reciprocated fully forward by the release of the hammer 80 (i.e., when in the position shown in FIGS. 6 and 7).

The roller portion 92 also includes a retaining protrusion 134 that extends laterally therefrom for receiving a coil portion of the coil spring 94. The retaining protrusion 134 abuts and is received by a mounting recess (not shown for clarity) formed in the housing 70.

The wing portion 124 extends perpendicularly from the roller portion 92 and has a mounting block 136 formed at a distal tip thereof. The mounting block 136 includes a hole 138 that receives a first arm 140 of the coil spring 94. In the assembled firearm 60, as shown in FIGS. 4-7, the mounting block 136 lies in the path of reciprocation of the hand 102, such that the reciprocation of the hand 102 in response to the actuation of the trigger 66 causes the hand 102 to engage and rotate the mounting block 136 about the axis of the roller portion of the drop safety 88.

The coil spring 94 also includes a second arm 142 that extends from the opposing end of the coil spring 94. The second arm 142 engages an anchoring surface of the housing 70.

It should be appreciated that the installation of the drop safety 88 does not impact the installation of the trigger 66, the hammer 80, the sear 74 or the other components of the firing mechanism 68. Instead, the drop safety 88 is installed independently of the trigger 66, the hammer 80 and the sear 74, and, at most, acts as a resting surface against which the firing pin 86 is installed. It should be appreciated that, if anything, the drop safety 88 facilitates installation of the firing mechanism 68, rather than impedes or increases the complexity of the installation thereof.

It should be understood that the foregoing description is only illustrative of the invention. Various alternatives and modifications can be devised by those skilled in the art without departing from the broader aspects of the present invention.

For instance, it should be appreciated that the drop safety can be used with other types of firearms, not just revolvers.

In addition, it should be appreciated that the firearm can utilize a hammer-type firing mechanism, as discussed above, or a striker-type firing mechanism.

Further, it should be appreciated that the drop safety of the present invention is particularly suited for use with firearms having non-metallic components, as disclosed in U.S. patent application Ser. No. 12/648,902 entitled "FIREARM HAVING NONMETALLIC COMPONENTS"; U.S. patent application Ser. No. 12/650,038 entitled "AN AUTOMATIC FIRING PIN BLOCK SAFETY FOR A FIREARM"; U.S. patent application Ser. No. 12/650,124 entitled "A MANUAL SLIDE AND HAMMER LOCK SAFETY FOR A FIREARM"; U.S. patent application Ser. No. 12/650,217 entitled "A CONFIGURABLE SIGHT FOR A FIREARM"; U.S. patent application Ser. No. 13/074,734 entitled, "INTEGRAL, FRAME-MOUNTED LASER AIMING DEVICE"; U.S. patent application Ser. No. 13/074,824 entitled "TWO-PIECE TRIGGER AND SPRING RETENTION SYSTEM"; and U.S. patent application Ser. No. 13/220,958 entitled, "FRAME MOUNTED LASER AIMING DEVICE", which are owned by the assignee of the present invention and are incorporated by reference herein.

What is claimed is:

1. A firearm comprising:

a hammer type firing mechanism having a hammer; and a trigger being in mechanical communication with the hammer type firing mechanism;

a firing pin being positioned to be actuated by the hammer upon actuation of the trigger;

a roller portion being rotatably positioned to block a forward reciprocation of the firing pin in a first position and rotatably positioned to allow a forward reciprocation of the firing pin in a second position, the roller portion having an outer circumferential surface being releasably engageable with a surface of the firing pin.

2. The firearm of claim 1, further comprising a spring, the spring rotationally biasing the roller portion so that the outer circumferential surface of the roller portion blocks the firing pin from reciprocating axially forward unless and until the trigger is actuated.

3. The firearm of claim 1, wherein the roller portion comprises an inner limiting wall that creates a fixed stop for the firing pin and the forward axial reciprocation thereof, the roller portion rotating in response to the actuation of the trigger so that the inner limiting wall faces the firing pin.

4. The firearm of claim 1, wherein the firing pin defines an axial carveout along a bottom surface thereof, the axial carveout being positioned between a front wall and a rear wall on the firing pin, the rear wall comprising the rearward surface releasably engaged with the outer circumferential surface of the roller portion.

5. The firearm of claim 4, wherein each of the front wall and rear wall of the firing pin are angled between about forty-five degrees and about ninety degrees.

6. The firearm of claim 1, further comprising a hand being connected with the trigger, wherein the roller portion includes a wing portion positioned to be engaged with the hand upon actuation of the trigger.

7. The firearm of claim 1, wherein the roller portion includes a spring and a wing portion, the spring being positioned against the wing portion to pivotally rotate the roller portion into the first position to block forward reciprocation of the firing pin.

8. The firearm of claim 1, wherein the roller portion defines a sectional carveout along at least a portion thereof.

9. The firearm of claim 4, wherein the axial carveout of the firing pin extends substantially half way through the firing pin.

* * * * *